US010165835B2

(12) United States Patent
Sunne et al.

(10) Patent No.: US 10,165,835 B2
(45) Date of Patent: Jan. 1, 2019

(54) BRAZED JOINT FOR ATTACHMENT OF GEMSTONES TO EACH OTHER AND/OR A METALLIC MOUNT

(71) Applicant: Forever Mount, LLC, Tucson, AZ (US)

(72) Inventors: Wayne L. Sunne, Tucson, AZ (US); Jim Hicks, Tucson, AZ (US); Rick Pierini, Tucson, AZ (US); Ed Liguori, Thousand Oaks, CA (US); Quent Duden, Tucson, AZ (US)

( * ) Notice: Subject to any disclaimer, the term of this patent is extended or adjusted under 35 U.S.C. 154(b) by 777 days.

(21) Appl. No.: 15/021,422

(22) PCT Filed: Aug. 20, 2013

(86) PCT No.: PCT/IB2013/002350
§ 371 (c)(1),
(2) Date: Mar. 11, 2016

(87) PCT Pub. No.: WO2014/030068
PCT Pub. Date: Feb. 27, 2014

(65) Prior Publication Data

US 2016/0219991 A1 Aug. 4, 2016

Related U.S. Application Data

(63) Continuation of application No. 13/971,440, filed on Aug. 20, 2013, now Pat. No. 9,204,693.

(60) Provisional application No. 61/691,245, filed on Aug. 20, 2012.

(51) Int. Cl.

| | |
|---|---|
| ***A44C 17/02*** | (2006.01) |
| ***A44C 17/04*** | (2006.01) |
| ***A44C 27/00*** | (2006.01) |
| ***A44C 17/00*** | (2006.01) |

(52) U.S. Cl.
CPC ..... *A44C 17/02* (2013.01); *A44C 17/00* (2013.01); *A44C 17/04* (2013.01); *A44C 27/00* (2013.01); *A44C 27/003* (2013.01)

(58) Field of Classification Search
CPC ..... A44C 17/04; A44C 17/02
USPC ..... 29/10; 63/26–28
See application file for complete search history.

(56) References Cited

U.S. PATENT DOCUMENTS 8,087,852 B2 * 1/2012 Muraki ..... B23B 27/20 407/101

FOREIGN PATENT DOCUMENTS

EP 2327323 A1 * 6/2011 ..... A44C 17/04

* cited by examiner

*Primary Examiner* — Jack W Lavinder
(74) *Attorney, Agent, or Firm* — Steven M. Crosby; Feldman Law Group, P.C.

(57) ABSTRACT

The specification relates to a gemstone setting. The gemstone setting includes a gemstone, a mounting surface and a braze joint. The braze joint is formed from a reactive metallic alloy with the reactive metallic alloy adhering the gemstone to the mounting surface. The braze joint is substantially concealed from a direct line of sight from a top portion of the gemstone by preventing excessive alloy from getting outside a desired braze area.

8 Claims, 11 Drawing Sheets

SINGLE POINT MOUNT

SINGLE POINT MOUNT

WIRE IN TUBE CRIMP

WIRE IN TUBE COUNTER BORE

BRAZED JOINT FOR ATTACHMENT OF GEMSTONES TO EACH OTHER AND/OR A METALLIC MOUNT

BACKGROUND

The disclosed technology relates generally to a brazed attachment of gemstones to themselves and/or a metallic mount.

Currently, gemstones are held in place by one or more mechanical methods. Prongs and channel set are two examples that are commonly used. Gemstones are clamped or retained to maintain position within the setting. Rings, tiaras, bracelets, broaches, earrings, studs and necklaces all employ a retention mechanism to keep gemstones attached. Bonding may also be used but due to the properties associated with bonding the reliability makes this method less desirable. Soldering is typically done as a metal to metal joint. Other methods exist that employ wire wrapping or other forms of containment but not direct chemical bond to the gemstone. Compression is also employed in a tension mount which contains the gemstone without a bond.

SUMMARY

The disclosed technology relates generally to a gemstone setting comprising: a gemstone; at least one mounting surface; and at least one braze joint, the at least one braze joint being formed from a reactive metallic braze alloy, the braze joint adhering the gemstone to the mounting surface, the braze joint being substantially concealed from a direct line of sight from a top portion of the gemstone by preventing excessive alloy from extending beyond a desired braze area near the girdle region, whereby a vastly more secure mount is provided where each individual joint fully retains the stone.

In some implementations, the mounting surface is a surface of a hollow mounting rod and excess alloy is prevented from extending beyond the desired braze area by delivering the reactive metallic alloy to the desired braze area through the hollow mounting rod or excess alloy is prevented from extending beyond the desired braze area by inserting the reactive metallic alloy inside the hollow mounting rod, constraining the reactive metallic braze alloy within a controlled volume inside the hollow mounting rod, and thermal brazing a delivered amount of the reactive metallic alloy. The brazed hollow mounting tube can be attached to the gemstone setting.

In some implementations, the mounting surface is a surface of a second gemstone and excess alloy is prevented from extending beyond the desired braze area by positioning a foil containing the reactive metallic alloy, such as, Incusil ABA by Wesgo Metals, on the desired braze area. The gemstone can be retained via pressure against a table of the gemstone and the desired braze area with the reactive metallic alloy being placed between the desired braze area and the mounting surface.

In some implementations, the mounting surface is a surface of the gemstone setting and excess alloy is prevented from extending beyond the desired braze area by positioning a foil, a rod, a wire, a paste or a powder containing the reactive metallic alloy on the desired braze area or excess alloy is prevented from extending beyond the desired braze area by positioning a rod containing the reactive metallic braze alloy on the desired braze area or excess alloy is prevented from extending beyond the desired braze area by surrounding the desired braze area with a braze stopoff material, such as, "STOPYT" ™ Morgan Advanced Ceramics.

In some implementations, the braze joint can be substantially concealed from a direct line of sight from a top portion of the gemstone by positioning the braze joint on or near a girdle or a surface of the gemstone or the braze joint is substantially concealed from a direct line of sight from a top portion of the gemstone by inherent internal reflection and surface refraction of the gemstone.

Other advantages of brazing include a jewelry setting that is less prone to catching on clothing, having fewer small voids for collecting dirt and are easier to maintain in general.

DETAILED DESCRIPTION

This specification describes technologies relating to a brazed joint for attachment of gemstones to each other and/or a metallic mount. More specifically, using a controlled atmosphere of inert gas or a vacuum, a braze joint can be formed to join diamonds, sapphires and/or other gemstones to each other or a mounting feature or a jewelry mounting. This attachment forms a durable foundation that doesn't conceal the stone but allows for a unique design that relies on contact away from the crown region. Contact may also be made anywhere desired for all types of configurations or cuts depending on desired geometry.

Brazing is used to attach diamond material to oil well bits and industrial saw blades. In these applications, a paste or matrix with ahoy encapsulates the diamond material and obscures most of the diamond material allowing some edges of the stone to be on a surface of the matrix for cutting purposes.

Figure 1:
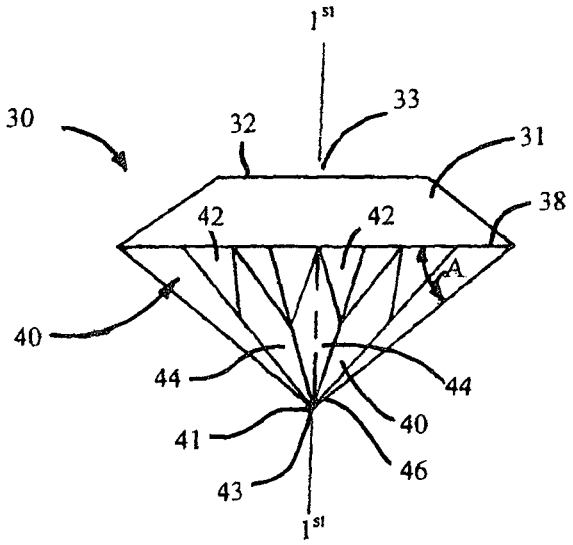
FIGS. 1 and 2 shows a side view of brilliant cut gemstone.

Traditional jewelry settings for gemstones have mounting means fixedly positioning the gemstone to the setting. As shown in FIG. 1, the gemstone 30 can have a crown 31, a table 32, a girdle 38, and a pavilion 40. Table 32 can have a center 33 that in combination with a center 43 of pavilion 40, defines a first longitudinal axis. The table 32 can be flat and may define a first plane. The pavilion 40 has a plurality of lower girdle facets 42 and pavilion facets 44. A pavil angle-A is defined between a first plane defined by girdle 38 and an external wall 46 of pavilion 40. Pavilion 40 defines a culet 41. The size of the table affects the gemstone appearance. For example, the larger the size of the table, the greater the brilliance or sparkle of the diamond, but this produces a corresponding reduction in the fire of the diamond. Preferred table dimensions for brilliant stones are between 53% and 57.5% of the width of the gem.

The brilliance of the diamond results from its very bright and smooth surface for reflection in combination with its high refractive index. Diamonds are cut in a manner such that when a viewer is looking at the crown/table, the light entering the diamond through the table/crown is reflected within the diamond by the pavilion's facets and exits through facets on the crown or the table for the benefit of the viewer. Fire describes the ability of the diamond to act as a prism and disperse white light into its colors. Fire is evaluated by the intensity and variety of color.

Figure 2:
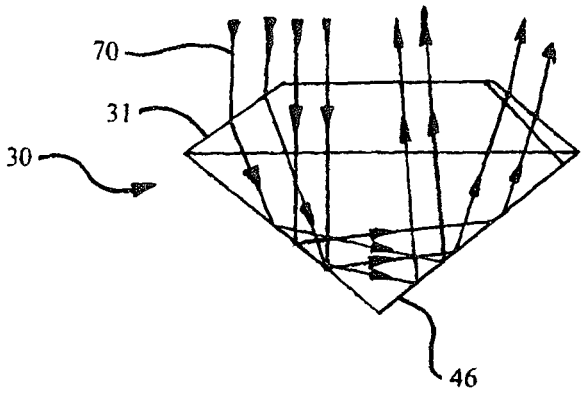

Referring now to FIG. 2, light 70 is shown as idealized parallel rays, generally aligned with the first longitudinal axis, entering brilliant cut gem 30 through crown 31. In this one example light 70 reflects through the interior of gem 30 before exiting out through crown 31. When cut within preferred guidelines, the brilliant cut diamond has aligned crown and pavilion facets, an overall symmetry, and a fine highly reflective finish configured to return the maximum amount of reflected light 70 from within the gem. Natural white light can enter crown 31, for example, at any angle either as direct or reflected light 70. Similarly natural light can enter the pavilion facets and pass through the table either directly or by reflected light. It is therefore especially important that the facets have as little contact as possible with the support or holding means. Diamonds come in a wide variety of shapes, such as round, oval, marquise, triangle and rectangular and a wide variety of cuts including brilliant, modified brilliant, emerald, square, cushion modified cushion, aasher, and many others each having unique and differing optical properties which are vulnerable to unplanned leakages of light or losses 74. Losses 74 occur due to the non-uniformity or randomness of natural light 70, type of diamond, manufacturing of the diamond outside of the preferred guidelines, imperfections within the diamond, and flaws in the surface finish, for example. Therefore it is very important to have the most light possible entering the diamond.

Other losses occur based on how the gemstone is mounted on a jewelry setting, e.g., gemstones held in place by prongs block light from entering and leaving the gemstone or gemstones held in place in an invisible setting where grooves are cut into the pavilion create permanent and irreparable imperfections in the gemstone. Losses occur because these mounting techniques block or alter the surface of the diamond from natural light thereby lowering the brilliance and fire of the gemstone and also altering a gemstone's color.

This specification describes technologies relating to a brazed joint for attachment of gemstones to themselves and/or a metallic mount. Brazing occurs above 450 C, soldering is below 450 C Brazing is a metal-joining process whereby a filler metal is heated above melting point and distributed between two or more close-fitting parts by direct contact and capillary action. The filler metal is brought slightly above its melting (liquidus) temperature while protected by a suitable atmosphere. It then flows over the base metal (known as wetting) and is then cooled to join the workpieces together.

In order for a brazing technique to be applied in a jewelry setting for gemstones, a limited amount of alloy is used in regions of the gemstone which minimize alloy needed and lowers obscurations. That is, instead of merely capturing the gemstone, the braze technique of the disclosed technology provides directly attaching the gemstone to, e.g., another gemstone, a jewelry setting or an attachment rod in a manner that is aesthetically pleasing and adds to the brilliance, fire and scintillation of the gemstone while minimizing color change. The attachment point on the gemstone can be anywhere on the diamond, for example, in some implementations the attachment point can be on the girdle, on the pavilion near the girdle or, or on the crown near the girdle.

Other important factors to consider when using a braze joint in a jewelry setting is to (1) have tight temperature control during brazing, (2) have a coefficient of thermal expansion compatibility of materials, (3) good mechanical joint fit at the proper location on the gemstone, and (4) a proper metal alloy to promote active braze alloys (ABA) joint formation. In order to obtain high-quality brazed joints, the gemstones and the attachment point must be closely fitted. In most cases, joint clearances of 0.02 to 0.06 mm are recommended for the best capillary action and joint strength and direct contact is preferred.

The braze used in the disclosed technology creates an interface layer that reacts with both gemstone and metal attachment or another gemstone. It is important to control, limit and/or restrict the braze alloy in a butt joint to prevent excessive alloy from getting outside the desired braze area. The desired braze area size depends on the application. In one implementation, using an 18 gauge or 1 mm diameter joint gives a load carrying capability of between approximately 10 to 25 lbs. It is worthy to note that the joint size is a function of the area so strength drops off as the square of the radius, meaning that smaller joints may be possible if strength is adequate for the application. Also, larger stones do not require much larger joints than smaller carat stones. A properly placed braze joint creates a desired braze area that is concealed from view from the front of the gem by surface refraction and internal reflection, and hence does not materially affect its brilliance, fire, scintillation or color. The optical efficiency loss for a round brilliant cut in a four prong mount is more than four times greater than for the brazed joint design. This translates into increased brilliance and prevents color loss with the single point brazed joint design.

The techniques described in the disclosed technology can control the amount of alloy in a braze joint by utilizing, e.g., a tube delivery system, a rod with a braze foil attached, placement of a stop material around a desired joint area and/or using an alloy foil or wire in a controlled manner (e.g., a array of small dots), to name a few. The amount of braze must be restricted otherwise, the braze can be seen through a top portion (crown/table) of the diamond thereby effecting its brilliance, fire and scintillation. Another issue with excess alloy is that a large amount of excess may cause fracturing of the gemstone where excess droplets form.

Figure 3A:
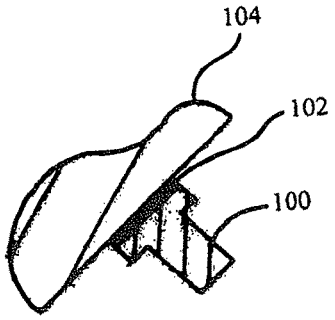
FIG. 3*a-b* shows a side view of an implementation of a universal mount as disclosed in the specification.
Figure 3B:
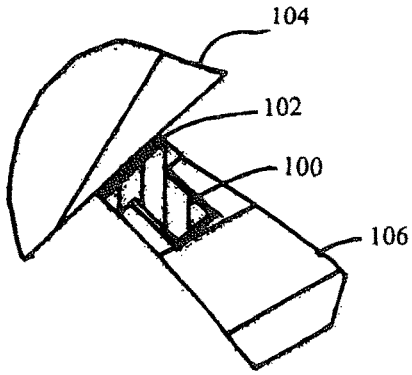

In one implementation, as shown in FIGS. 3*a-b*, a tube 100 is used as a delivery method. For example, a long tube configuration, such as, a hollow tube or intermediate post 100 can be used with wire alloy 102 placed within a hollow section of the tube to feed the joint. The wire alloy is then inserted into the tube until the wire alloy is near flush or extended about 0.25 mm from a surface of the mounting surface. Once the wire alloy is in place, the tube is crimped thereby controlling the amount of wire alloy delivered to the mounting surface. The hollow tube or intermediate post 100 may then be brazed in a vacuum furnace directly to the gemstone. Once attached, the combination gemstone and tube may be positioned and attached to a jewelry mount mounting, as shown in FIG. 3*b*. Size of the intermediate post may vary depending on the setting and desired interface with the jewelry. In some cases, if the desired braze area extends beyond the outer area of the mounting tube, the excess braze may be completely concealed by a mounting sleeve. The mounting sleeve can be made of a precious metal that is part of or positioned near the jewelry setting. In another implementation, the tube may be made of a dissolvable material and once the braze is set, the tube may be dissolved and the braze joint itself may be mounted to a jewelry setting.

This delivery method provides improved flow and increased braze alloy volume without excessive joint growth. In use, the tube 100 may be stainless steel but other tube materials can be used, e.g., Niobium, Titanium, Platinum, Stainless Steel and non-zinc gold alloy (as zinc in 14 k gold is not compatible with vacuum braze). The use of Niobium and Titanium has a more favorable chemistry for brazing and are also much less expensive than using platinum or gold.

The alloy 102 can be an silver based ABA braze alloy because the ABA braze alloy has the proper chemistry to braze to both the gemstone and the metallic member. The composition percentages of one of the braze alloys can be, e.g. 63.0% Ag 35.25% Cu, 1.75% Ti. Also, the reaction layer and braze joint of ABA alloys is much thinner than other adhesives and is easily concealed while providing an extremely strong attachment. Other active braze alloys, such as, 68.8% Ag, 26.7% Cu, 4.5% Ti can also be used as well as any alloy for effectively brazing gemstones.

Figure 4:
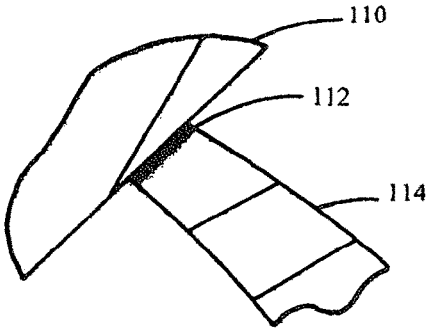
FIG. 4 shows a side view of an implementation of a direct mount as disclosed in the specification.

In another implementation, as shown in FIG. 4, a foil 112 is used in a controlled amount to prevent excessive alloy from getting outside the desired braze area. The foil is sandwiched between the gemstone 110 and the jewelry setting 114. The foil can have a thickness of about 0.002" with an external perimeter that is equal to or less than the perimeter of the mounting surface.

Figure 5:
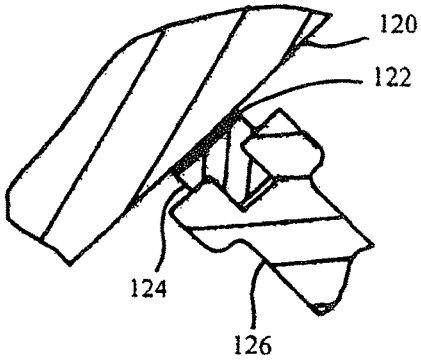
FIG. 5 shows a side view of an implementation of a heated mount for press fit as disclosed in the specification.
Figure 6:
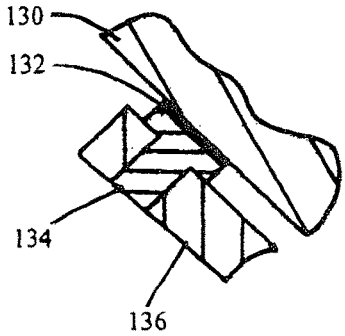
FIG. 6 shows a side view of an implementation of a secondary mount as disclosed in the specification.

In another implementation, as shown in FIGS. 5 and 6, a rod 124, 134 may be adhered to a jewelry setting 126, 136 and then brazed to a gemstone 120, 130. The rod can be 1 mm and the step is not necessary for all implementations.

Figure 7A:
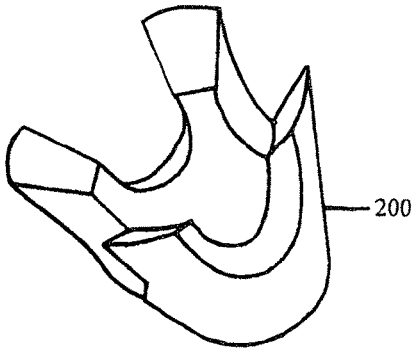
FIG. 7*a-c* shows prospective views of an implementation of a direct mount as disclosed in the specification.
Figure 7B:
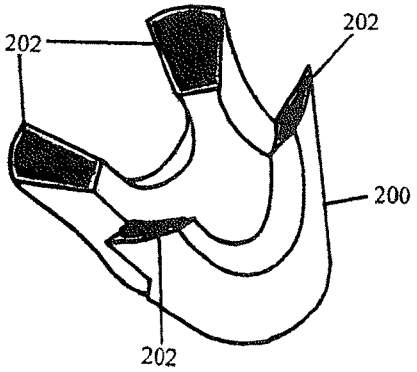
Figure 7C:
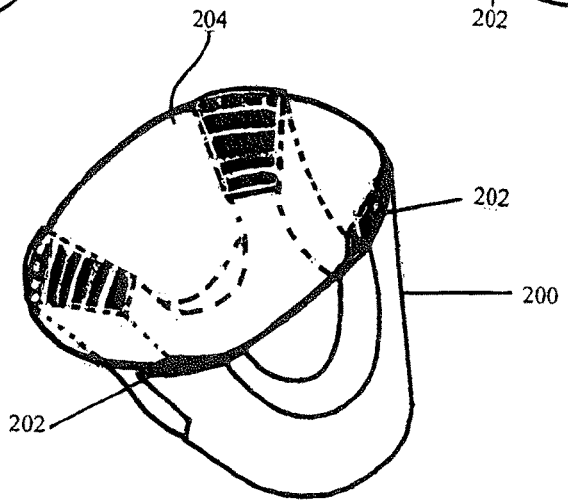

FIGS. 7*a-c* shows a method for attaching the gemstone 204 to a setting 200. First, a gemstone setting 200 is formed, FIG. 7*a*. The alloy 202 in the form of foil is placed on the setting 202. The gemstone 204 is then placed on the setting 200. Once placed, the gemstone 204 and the setting 200 are pressed against each other in a vacuum furnace and the alloy 202 is brazed. In some implementations, the positions of the prongs are deliberately not visible from the top of the stone. However, it would be possible to use this type of setting in a matrix with close spacing, like pave or an invisible setting. The apparatus for pressing the gemstone to the setting may include a recess for the setting to be restrained to prevent tipping and a dead weight placed on top of the table.

Figure 8A:
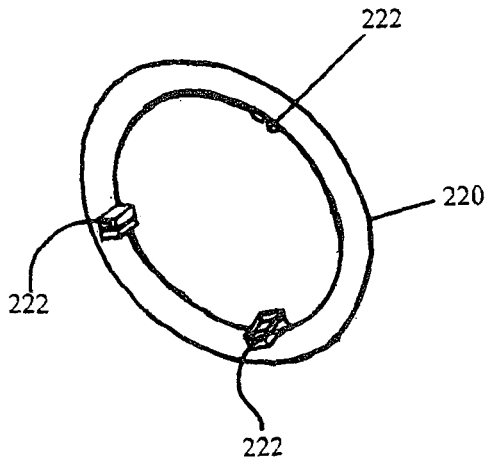
FIG. 8*a-b* shows prospective views of an implementation of a direct mount as disclosed in the specification.
Figure 8B:
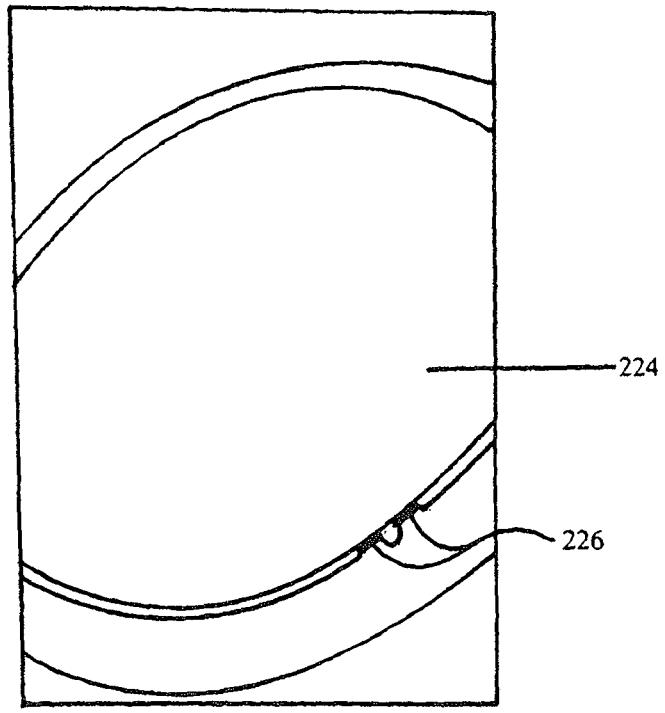

FIGS. 8*a-b* shows a method for attaching the gemstone 224 to a setting 220. First, a gemstone setting 220 is formed with mounting protrusions 222, FIG. 8*a*. The alloy 226 in the form of a foil is placed on the mounting protrusions 222. The gemstone 224 is then placed on the setting 220. Once placed, the gemstone 224 and the setting 220 are pressed against each other in a vacuum furnace and the alloy 226 is brazed. In another implementation, the mount can have a slot that could be used for a wire instead of foil. Once brazed this mount could be machined away to make a non-continuous ring if desired.

Figure 9A:
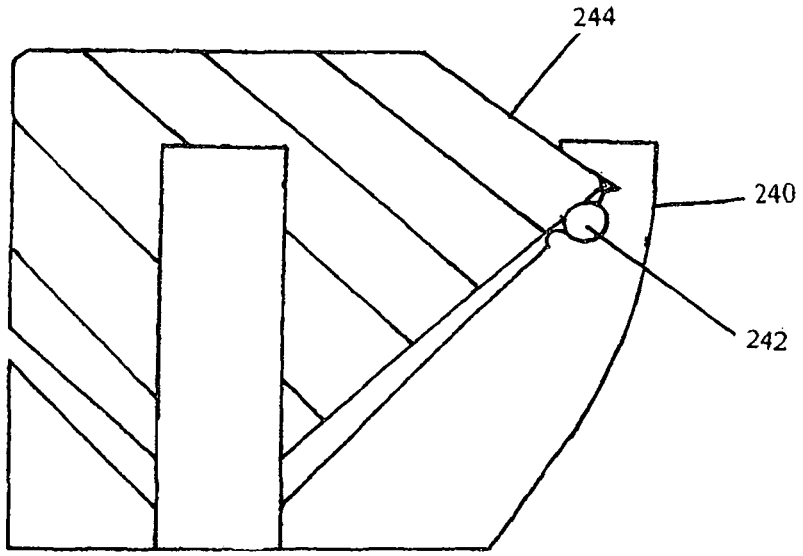
FIG. 9*a-b* shows prospective views of an implementation of a direct mount as disclosed in the specification.
Figure 9B:
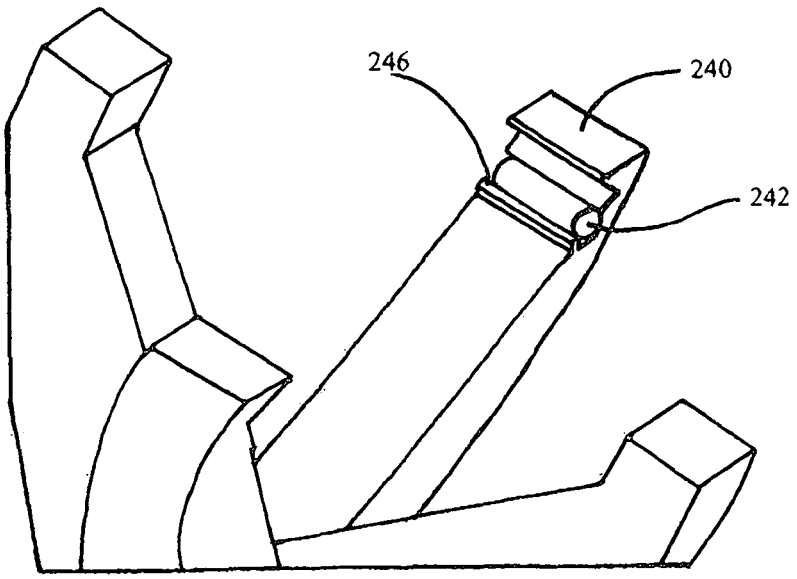

FIGS. 9*a-b* shows a method for attaching the gemstone 244 to a setting 240. First, a gemstone 244 setting is formed, FIG. 9*a*. The alloy 242 in the form of rod is placed on the setting 202 with a void 246. The gemstone 244 is then placed on the setting 240. Once placed, the gemstone 244 and the setting 240 are pressed against each other in a vacuum furnace and the alloy 242 is brazed. In some implementations, prongs could be used to provide compression during brazing. The prongs may be left in place to provide a traditional look while providing the durability of brazing or the top of the prongs could be removed.

Figure 10A:
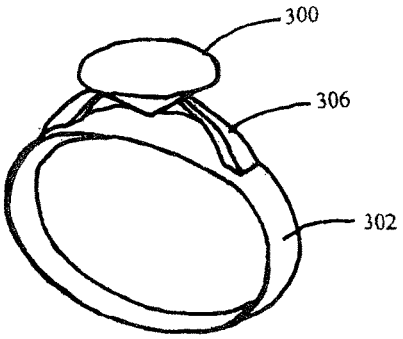
FIG. 10*a-c* shows prospective views of an implementation of a secondary mount as disclosed in the specification.
Figure 10B:
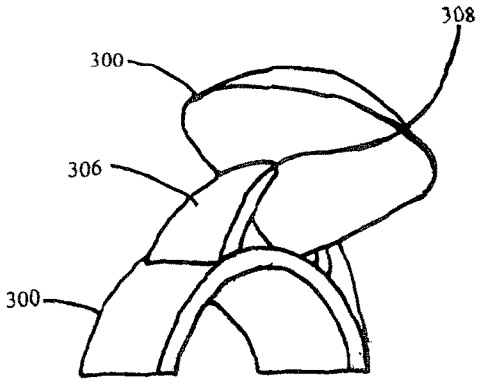
Figure 10C:
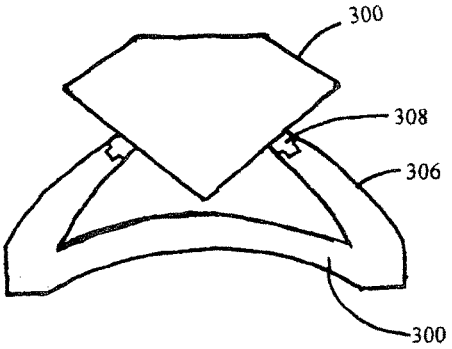

In some implementations, a face bond "butt joint" geometry is used to enable mounting to any face desired. As shown in FIGS. 10*a-c*, attaching directly to the gemstone away from the crown and near or on the girdle allows for a clear presentation of the gemstone without prongs or other retaining features blocking desirable brilliance. Light refracted and reflected will more easily reach the wearers eye and unleash the gemstones entire potential beauty without mounting features blocking its full display. Another advantage is the strength inherent in the braze process.

Figure 11A:
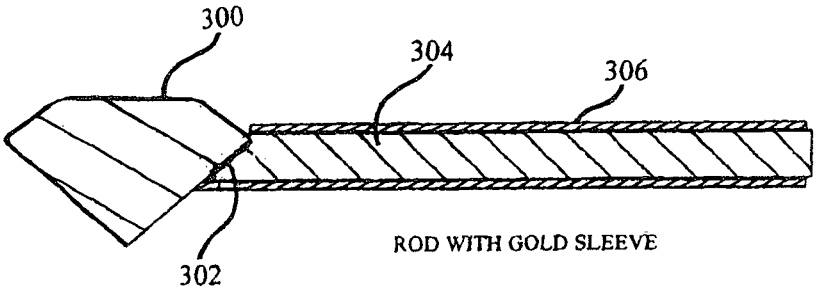
FIG. 11*a-f* shows prospective views of an implementation of a single point mount as disclosed in the specification.
Figure 11B:
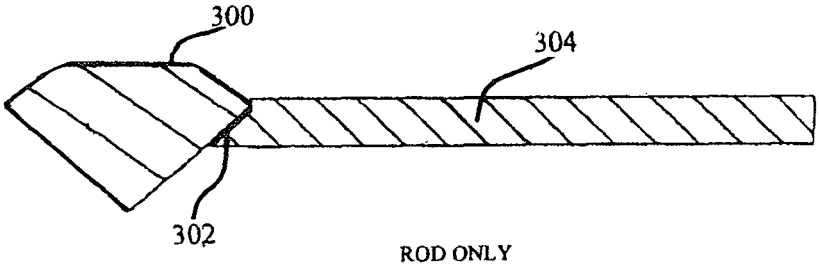
Figure 11C:
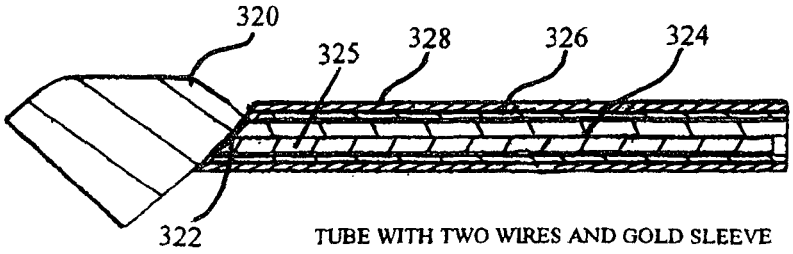
Figure 11D:
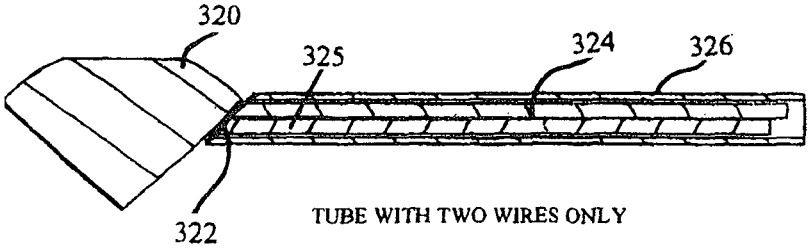
Figure 11E:
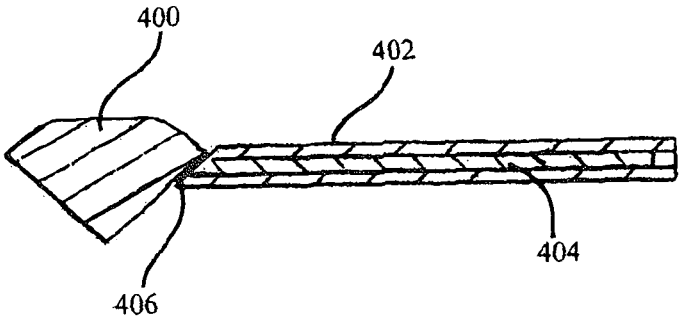
Figure 11F:
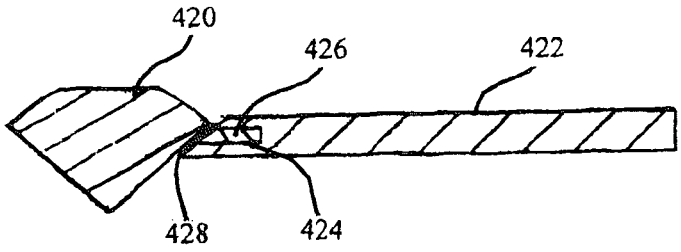

In FIGS. 11*a-d*, a single point mount is shown. In FIGS. 11*a-b*, gemstone 300 is brazed to rod 304 with braze joint 302. The use of rod 304 as an intermediate material acts as a universal mounting that could be inserted into a sleeve 306 or any jewelry "receiver" within a larger setting which may completely conceal the braze. This single point mount allows any gemstone to have a small attachment adhered to any surface that could then be integrated into any jewelry setting having a marrying receiver. The single point mount is different from the prior art because it is not a capability achievable for prongs. In FIGS. 11*c-d*, gemstone 320 is brazed to tube 326 with braze joint 322. The braze joint can be formed by two braze wires 324, 325 or by using 1 wire, as shown in FIGS. 11*e-f*. In FIG. 11*e*, the hollow tube 402 contains a single wire 404 and is brazed to gemstone 400 with braze joint 406. The use of the tube 306 as an intermediate material acts as a universal mounting that could be inserted into a sleeve 328 or any jewelry "receiver" within a larger setting. In some implementations, as shown in FIG. 11*f*, instead of a hollow tube, a solid rod 422 with a void 426 on the end may be used to control the braze joint 428. That is, a desired amount of braze alloy 424 may be feed into the void 426 and then brazed as described throughout the specification.

Figure 12:
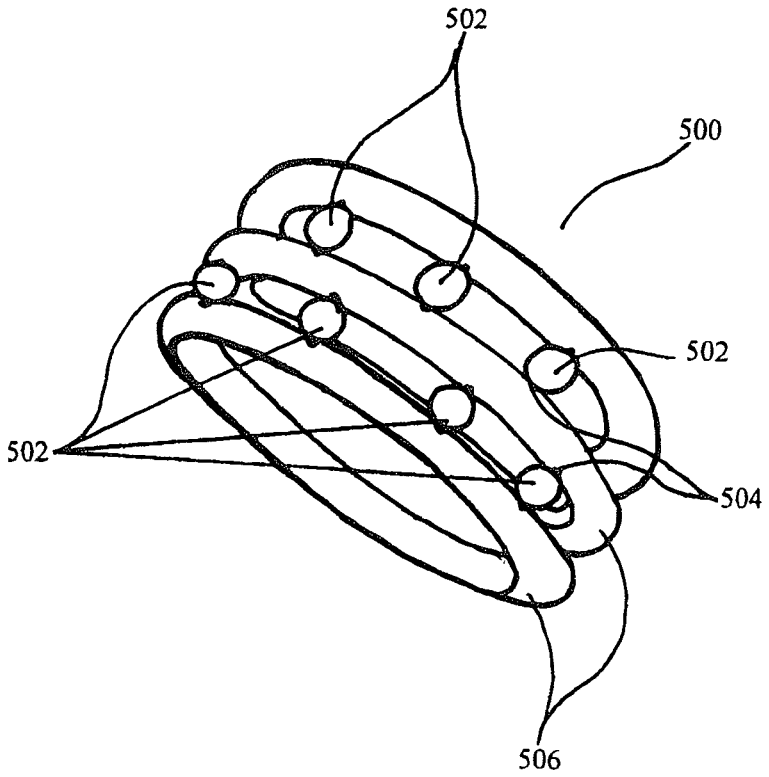
FIG. 12 shows a prospective view of an implementation of coil-shaped ring with gemstones using a braze joint as described in the specification.
Figure 13:
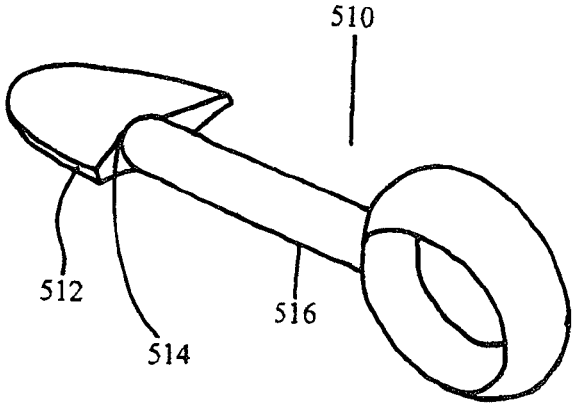
FIG. 13 shows a prospective view of an implementation of pendent with a gemstone using a braze joint as described in the specification.
Figure 14:
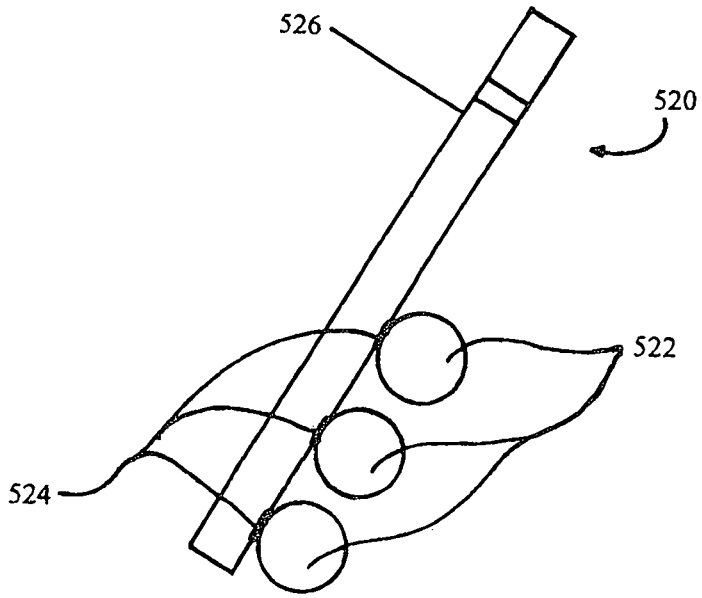
FIG. 14 shows a prospective view of an implementation of a pendent with gemstones using braze joints as described in the specification.
Figure 15:
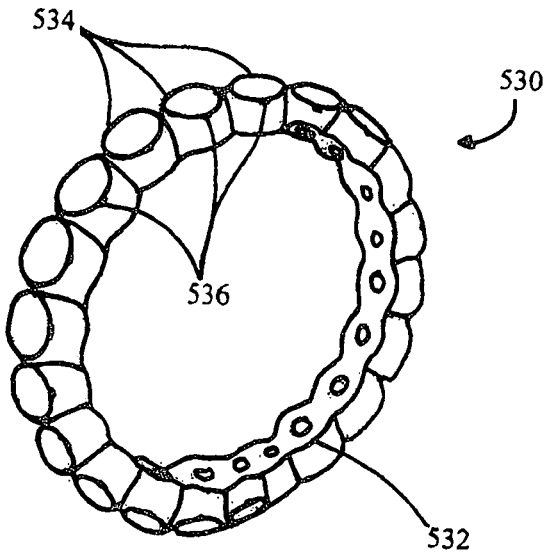
FIG. 15 shows a prospective view of an implementation of a ring with gemstones using braze joints as described in the specification.
Figure 16A:
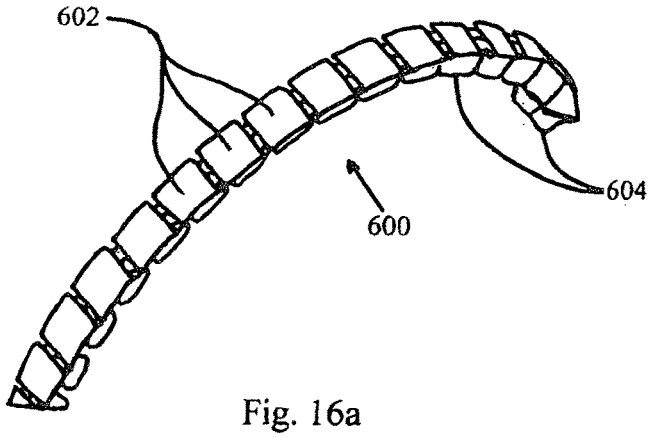
FIG. 16*a-d* shows prospective views of an implementation of a bracelet with gemstones using braze joints as described in the specification.
Figure 16B:
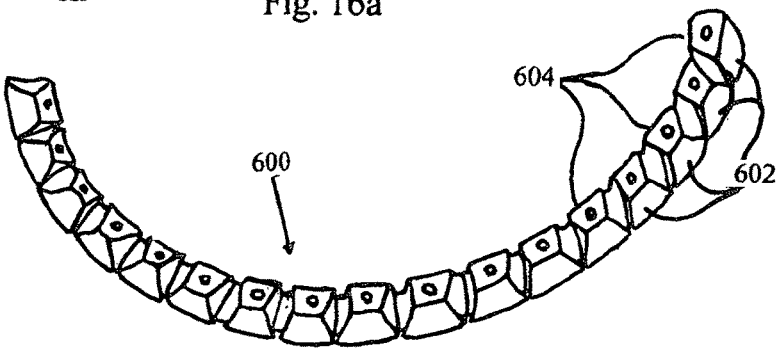
Figure 16C:
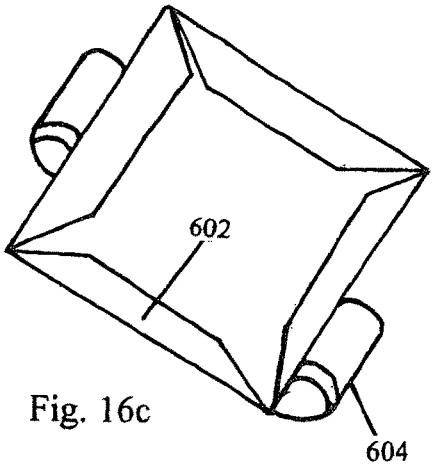
Figure 16D:
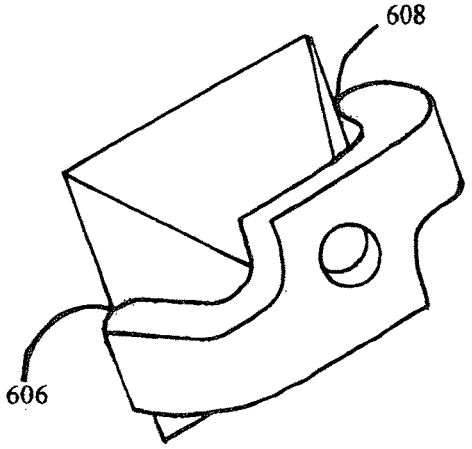

FIG. 12 shows a coil-shaped rind 500 with gemstones 502 being brazed between coil elements 506 with braze joint 504. FIG. 13 shows a pendent 510 with a single gemstone 512 being brazed to a rod 516 of the pendent 510 with a single point braze joint 514. FIG. 14 shows a pendent 520 with three gemstones 522 with each gemstone 522 being mounted on a rod 526 of the pendent 520 with a single point braze joint 524. FIG. 15 shows a ring 530 with multiple gemstones 534 being mounted on a setting 532 with braze joints 536. FIGS. 16*a-d* show a tennis bracelet 600 having multiple princess-cut gemstones 602 with each gemstone

602 being mounted on an interlock setting 604 with braze joints 606 and 608. The interlock settings 604 being interlocked together to form the bracelet 600.

The brazing process can be performed in a vacuum furnace. A vacuum furnace is a type of furnace that can heat materials, typically metals, to very high temperatures, such as, 600 to over 1500° C. to carry out processes such as brazing, sintering and heat treatment with high consistency and low contamination. In a vacuum furnace the product in the furnace is surrounded by a vacuum. The absence of air or other gases prevents heat transfer with the product through convection and removes a source of contamination. Some of the benefits of a vacuum furnace are: uniform temperatures in the range around 700 to 1000° C., temperature can be controlled within a small area, low contamination of the product by carbon, oxygen and other gases, quick cooling (quenching) of product. The process can be computer controlled to ensure metallurgical repeatability. Other brazing techniques are contemplated, e.g., induction brazing, laser brazing or any other method that may work in an inert environment.

One example of the brazing process is as follows. (1) Prepare a gemstone by rinsing with acetone. (2) Inspect the surface of gemstone where braze joint is desired to ensure cleanliness. (3) Prepare a metallic setting rod/tube by rinsing with the rod/tube with acetone. (4) Inspect a brazing surface of the mount to ensure cleanliness. (5) Check proper joint geometry with respect to gemstone mounting location. (6) Clean, cut and apply braze alloy foil to rod braze face, or clean cut and load braze alloy wire into tube, flush (or near flush) with braze face. (7) Load alloyed rod/tube into brazing fixture and secure in place. (8) Load gemstone into brazing fixture (9) Position and secure gemstone such that the braze alloy and joint interface are positioned per the prescribed location on the gemstone. (10) Adjust rod/tube to match braze face angles and tighten securely. (11) Place assembled brazing tool in Vacuum furnace and attach thermocouples to assembly or tool, and (12) Program and braze the assembly per the desired thermal parameters as described below.

In some implementations, the steps or parameters of the brazing procedure in a vacuum furnace are as follows: (1) the assembled brazing tool is placed into an all Moly Vacuum Furnace, (2) pump furnace down to 5× 10-5 Torr or better, (3) heat to 500 F+/−100 F at 1500 F/hr for 15-20 minutes, (4) heat to 1000 F+/−50 F at 1500 F/hr for 15-20 minutes, (5) heat to 1390 F+/−15 F at 1500 F/hr for 20-30 minutes, (6) heat to 1530 F-1550 F at 1800 F/hr for 12-18 minutes, (7) vacuum Cool to below 1200 F, (8) argon cool to below 250 F, (9) remove and dissemble the brazing tool. Please note that these parameters apply to Cusil ABA (Wesgo Metals™) chemistry being 63% Ag, 35.25% Cu, and 1.75% Ti.

In some implementations, the braze alloy can contain titanium. This titanium which reacts with the ceramic to form a reaction layer. In use, the more the titanium used, the higher the braze temperature needed. In other implementations, a low temperature alloy is used. In either case, the chemical bonding that occurs provides a resilient mounting which can be attached to either a universal mount or directly to jewelry mounting. Joints made using braze techniques are strong and durable.

It is contemplated to use dissolvable ceramic fixtures for a pave settings. For example, using dissolvable tooling to make pave settings with attachment of stones to each other In other words, a complex matrix can be made out of a dissolvable mold that makes the finished jewelry look unsupported. These molds can be make with a 3 d printer in almost any conceivable shape, inserting the braze alloy and gemstones during the printing process.

It is also contemplated to process multiple stones in a single furnace braze operation to reduce cost.

While this specification contains many specific implementation details, these should not be construed as limitations on the scope of the disclosed technology or of what can be claimed, but rather as descriptions of features specific to particular implementations of the disclosed technology. Certain features that are described in this specification in the context of separate implementations can also be implemented in combination in a single implementation. Conversely, various features that are described in the context of a single implementation can also be implemented in multiple implementations separately or in any suitable subcombination. Moreover, although features can be described above as acting in certain combinations and even initially claimed as such, one or more features from a claimed combination can in some cases be excised from the combination, and the claimed combination can be directed to a subcombination or variation of a subcombination.

The foregoing Detailed Description is to be understood as being in every respect illustrative, but not restrictive, and the scope of the disclosed technology disclosed herein is not to be determined from the Detailed Description, but rather from the claims as interpreted according to the full breadth permitted by the patent laws. It is to be understood that the implementations shown and described herein are only illustrative of the principles of the disclosed technology and that various modifications can be implemented without departing from the scope and spirit of the disclosed technology.

The invention claimed is:

1. A gemstone setting comprising:

a gemstone;

at least two mounting surfaces; and at least two braze joints, the at least two braze joints being formed from a reactive metallic alloy, the at least two braze joints adhering the gemstone to the at least two mounting surfaces, the at least two braze joints being substantially concealed from a direct line of sight from a top portion of the gemstone by preventing excessive alloy from getting outside a desired braze area.

2. The gemstone setting of claim 1 wherein excess alloy is prevented from extending beyond the desired braze area by positioning a foil containing the reactive metallic alloy on the desired braze area.

3. The gemstone setting of claim 1 wherein the at least two mounting surfaces are surfaces of the gemstone setting.

4. The gemstone setting of claim 3 wherein the gemstone is retained via pressure against a surface of the gemstone and the desired braze area with the reactive metallic alloy being placed between the desired braze area and the at least two mounting surfaces.

5. The gemstone setting of claim 4 wherein excess alloy is prevented from extending beyond the desired braze area by surrounding the desired braze area with a stopping material.

6. A gemstone setting having a band portion and a mounting portion comprising:

a gemstone, the gemstone having a table, a crown and a pavilion;

at least one mounting surface on the mounting portion; and at least one braze joint, the at least one braze joint being formed from a reactive metallic alloy, the braze joint adhering the gemstone to the at least one mounting surface, the braze joint being substantially concealed from a direct line of sight from a top portion of the gemstone by preventing excessive alloy from getting outside a desired braze area, wherein the gemstone is mounted to the at least one mounting surface in such a way that the gemstone is raised above the band portion thereby allowing light to enter and exit the table, the crown and the pavilion of the gemstone.

7. The gemstone setting of claim 6 wherein excess alloy is prevented from extending beyond the desired braze area by positioning a foil containing the reactive metallic alloy on the desired braze area.

8. A gemstone setting comprising:

a gemstone, the gemstone having a table, a crown and a pavilion;

a mount, the mount including at least one mounting surface; and at least one braze joint, the at least one braze joint being formed from a reactive metallic alloy, the braze joint adhering the gemstone to the at least one mounting surface, wherein the gemstone is mounted to the at least one mounting surface on a single side of the gemstone in such a way that light is capable from entering and exiting the table, the crown and the pavilion of the gemstone from all substantially directions.

* * * * *